United States Patent [19]

Dicker

[11] Patent Number: 4,844,329

[45] Date of Patent: Jul. 4, 1989

[54] CONTINUOUS MAILER ASSEMBLY

[76] Inventor: David Dicker, 41 Penny La., Scarsdale, N.Y. 10583

[21] Appl. No.: 213,883

[22] Filed: Jun. 30, 1988

[51] Int. Cl.[4] ..... B65D 27/10

[52] U.S. Cl. ..... 229/69; 282/11.5 R; 282/11.5 A

[58] Field of Search ..... 229/69; 282/11.5 R, 282/11.5 A

[56] References Cited

U.S. PATENT DOCUMENTS 3,304,103 2/1967 Bensler, Sr. et al. ..... 282/11.5 A
3,941,308 3/1976 DiGirolomo et al. ..... 229/69
4,108,352 8/1978 Peschke ..... 229/69

FOREIGN PATENT DOCUMENTS 0055509 7/1982 European Pat. Off. ..... 229/69

*Primary Examiner*—Stephen Marcus
*Assistant Examiner*—Jes F. Pascua
*Attorney, Agent, or Firm*—Martin J. Spellman, Jr.

[57] ABSTRACT

This invention relates to an improved tentless mailer assembly and a method of fabricating the same. The mailer assembly is formed as a continuous assembly composed of a plurality of interconnected units that can be disposed in a stacked arry.

10 Claims, 2 Drawing Sheets

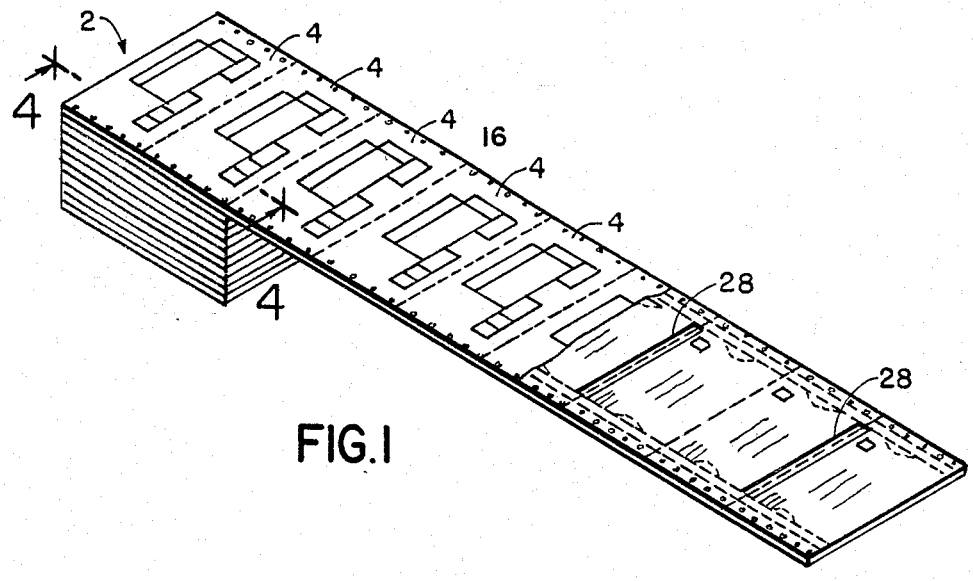
FIG.1
FIG.2
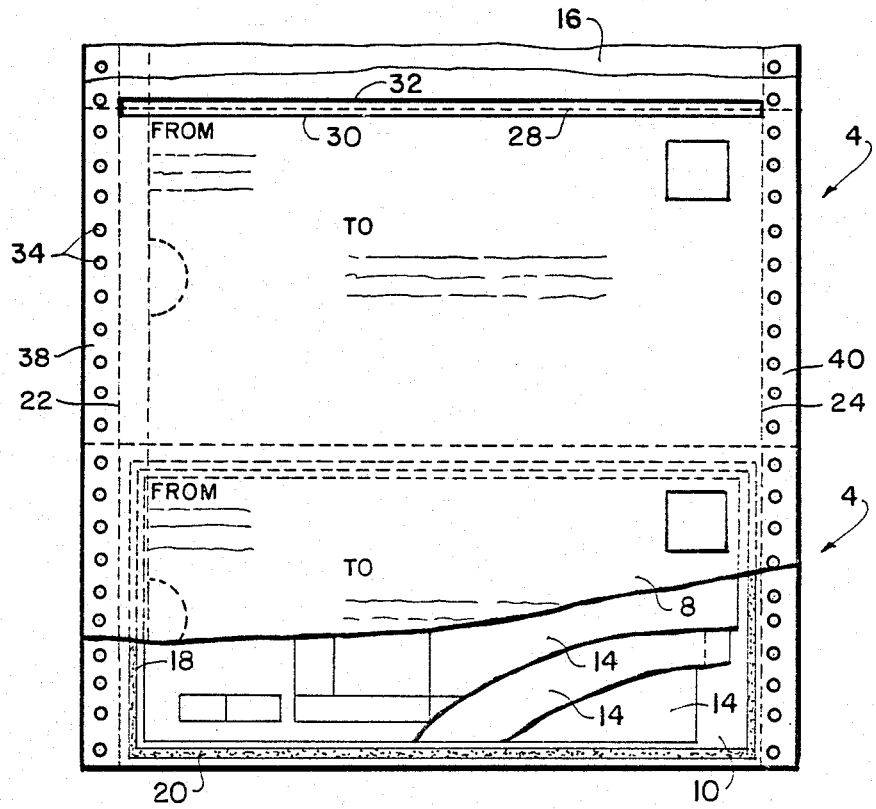

CONTINUOUS MAILER ASSEMBLY

BACKGROUND OF THE INVENTION

1. Field Of The Invention

This invention relates to an improved tentless continuous mailer assembly and a method of fabricating a tentless continuous mailer assembly.

It has been known to manufacture continuous mailer assemblies and similar business forms of multiple plies, such as described in U.S. Pat. Nos. 4,095,695 and 4,108,352 and to fold these assemblies into a stack for shipment purposes. In many cases, when a continuous assembly of this nature is being manufactured, the various plies are brought together and secured to each other via glues or adhesives which set at some point after bringing of the plies together. A final set of the adhesive or glue does not take place until some time after the assembly has been folded into a stack. As a result, the set adhesive or glue tends to retain the plies in a fixed condition relative to each other so that when the assembly is folded out from a stack, a peak or "tent" appears at the folds of the assemblies where the various plies are secured together.

"Tenting" presents a problem in the unfolded condition of a continuous assembly of the above type since automated equipment which process the assembly usually has pin wheels which register in pin holes along the side edges of the assembly in order to pass the assembly through the equipment. If a "tent" occurs in the assembly, registration of the pins in the sides of the assembly may not always occur. It is then possible for the assembly to lift away from the automatic equipment causing a jamming. In addition, "tenting" may cause a pick-up of the edges of the assembly plies about the tent to such an extent that the assembly can be torn by the automated equipment.

The tenting can also catch on the ink ribbon or the hammer slots or the type itself of the automatic equipment causing a jamming. The tenting can also cause a sufficient buildup of thickness so that equipment sensors will cause the equipment to stop since it senses that the forms are too thick to be processed.

2. Prior Art

Various attempts have been made to eliminate "tenting" from continuous business forms and assemblies. In U.S. Pat. No. 4,108,352 plies of material are held together via glue and in the intermediate plies are completely severed along adjacent edges to eliminate a bend in the intermediate ply at the fold of the assembly. The front and back plies, however are not completely severed. Thus, the connecting portions between adjacent sections of each of the front and back plies may still cause a tenting effect to occur.

In my earlier patent U.S. 4,492,334, a continuous mailer assembly was provided with mailer units in which one of the back or front plies was either completely severed from the adjacent ply or connected to the adjacent ply by a weak hinge connection. This somewhat minimized tenting but did not fully eliminate the difficulties of tenting because severing did not always occur when manufacturing due to the fact that a perforation had to fall exactly in line with a previously laid down perforation.

An object of the invention is to provide a continuous mailer assembly which is able to lay flat without tenting.

It is another object of the invention to provide a simple method of forming a continuous mailer assembly which is able to lay flat without tenting when folded out.

It is another object of the invention to provide a simple technique of fabricating a tentless continuous mailer assembly that does not have to rely on a previously laid down perforation to line up with a subsequent perforation.

SUMMARY OF THE INVENTION

The invention provides a continuous mailer assembly which is comprised of a plurality of interconnected units that can be disposed in stacked array and with each unit including a front ply, a back ply secured to the front ply to define an envelope, and at least one insert ply within the envelope. One of the front or back plies of one unit is unconnected with a respective ply of an adjacent unit, while the other of the front or back ply of the unit is connected with a similar ply of an adjacent unit in an interrupted manner, e.g. via perforations or the like.

The mailer assembly is constructed so that, the back plies of adjacent units being unconnected, the assembly can be folded and subsequently unfolded without any tenting occurring between the adjacent units. The connections which remain between the front plies permits hinging of the respective units together in only a single ply. As a result, folding and unfolding of the units can be readily carried out in an unrestrained manner, i.e. without any restraint from the unconnected back plies.

It is to be noted that the front plies may be unconnected with each other while the back plies are connected in an interrupted manner, or vice-versa.

In order to fabricate the mailer assembly the webs of paper have to be superimposed. One of the superimposed webs, being either the front or back plies of the envelope, is die cut at longitudinally spaced intervals. A strip of approximately 1/16 inch of paper is removed; extending between the removeable marginal strip perforations on the left and right sides. The webs of paper comprising the front and back of the envelope when superimposed are adhesively secured to each other within the longitudinally spaced intervals forming the envelope. Then, a perforating blade will cut the front and back plies simultaneously perforating the entire width of the ply that did not get die cut and only the removeable marginal strips on the left and right sides of the ply that is die cut. The perforating blade passes through the 1/16 inch die cut opening. This occurs at each fold of the stack of mailer assemblies.

The unconnected sections will not interfere with the folding and unfolding of the mailer assembly into and from a stacked array.

The present invention does not rely on extra perforations on one of the plies which will either sever or just weaken the area because it is difficult to register one perforation directly over a previous perforation. The present invention cuts and removes a strip approximately 1/16 inch of paper from one ply, extending between the removable marginal strip perforations on the left and right sides, so that just the other ply of the envelope hinges at the fold. The strip is die cut in a known manner prior to bringing the front and back and other plies together in registration with each other.

The continuous mailer assembly may also have more than one insert ply between the front and back plies.

The formed assemblies can be folded at those places where the adjacent sections of a web are unconnected to each other in a zig-zag manner to form a stack. When so folded, each layer of the stack may have two or more mailer units therein. In such cases, only those sections of a ply where folding is to occur need be unconnected.

When the mailer assembly is unfolded from a stacked array, for example, for feeding into an automatic processing machine, no "tenting" occurs between the individual units of the assembly. This results because the sections of the back plies (or the front plies) are unconnected to each other except at the marginal strips.

As with known mailer assemblies, the assembly can be provided with an overlying ply which, after feeding through an automatic processing machine, can be retained for audit purposes while the mailer units are mailed. Further, each of the webs may be provided with control pin holes along the side edges in order to facilitate processing in automatic equipment.

These and other objects and advantages of the invention will become more apparent from the following detailed description taken in conjunction with the accompanying drawings:

BRIEF DESCRIPTION OF THE DRAWING

In the accompanying drawing which forms a part of the specification:

FIG. 1 illustrates a continuous mailer assembly constructed in accordance with the invention;

FIG. 2 illustrates a top view of two adjacent units of a continuous mailer assembly according to the invention;

ILLUSTRATIVE SPECIFIC EMBODIMENT

Referring to FIG. 1, the continuous mailer assembly 2 is formed of a plurality of interconnected mailer units 4 which can be folded in a zig-zag manner into a stacked array. As shown, each layer of the stacked array has two mailer units 4 disposed in coplanar relationship.

Figure 3:
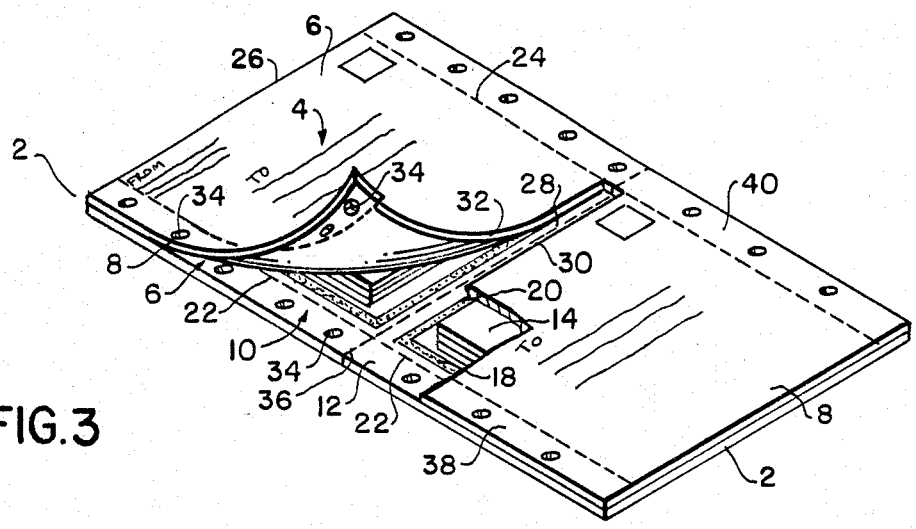
FIG. 3 illustrates a fragmentary view of a portion of the mailer assembly of FIG. 2.
Figure 4:
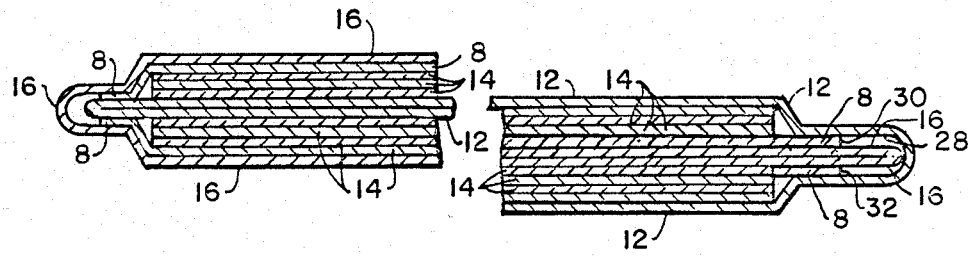
FIG. 4 illustrates a view taken along line 4—4 of FIG. 1.

Referring to FIG. 3, the mailer assembly 2 is fabricated from continuous webs of paper or the like. One web 6 serves to form a series of front plies 8, a second web 10 forms a series of back plies 12, one or more webs (not shown) are processed to form a plurality (e.g. three) of insert plies 14 and another web 16 forms a cover sheet.

As shown in FIG. 3, each mailer unit 4 includes a front ply 8, a back ply 12 and three insert plies 14 between the front and back plies 8, 12. In addition, suitable longitudinal lines 18 and transverse lines 20 of adhesive are provided between the front and back plies 8, and 12 to adhesively secure the plies 8 and 12 together to define an envelope. These lines of adhesive 18 and 20 also serve to frame the insert plies 14 within the envelope defined by the front and back ply 8 and 12 of each unit 4.

In addition, each of the webs 6, 10, and 16 is provided with a longitudinal line of weakening or perforations 22 and 24 on the sides in known manner so as to provide removable strips 38 and 40 respectively in which pin control holes 34 are located in a known manner.

The individual mailer units 4 are connected to each other via perforated lines 26 and 36 in the respective front and back plies 8 and 12.

In the example shown, the front plies 8 are separated by a transverse die cut opening 28 which is approximately 1/16 inch wide, extending from the removable strip perforations 22 on the left side to corresponding strip perforations 24 on the right side. The edges are indicated by numbers 30 and 32. The back plies 12 are separated by a transverse single line of perforations 36. This may be reversed so that plies 8 are perforated and plies 12 are die cut.

As shown in FIG. 3, the front plies 8 of the adjacent stacked layers are unconnected to each other while the back plies 12 remain connected in an interrupted manner by the transverse line of perforations 36. The complete severing of front plies 8 from each other permits folding of the mailer assembly 2 while the glue is wet, then drying while in the folded stacked array, and then unfolding after drying without any tenting at the folds.

In order to fabricate the mailer assembly 2, the three paper webs 6, 10, and 16 are generated to form the front plies 8, back plies 12 and a cover sheet 16, while three additional webs are generated to form the three insert plies 14. In this regard, the webs for forming the insert plies 14 are processed to define longitudinally spaced apart insert sections. This is a known technique.

The webs 6, 10, and 16 are collated into superposed relation in known manner. At this time, the webs forming the front and back plies 8 and 12 are adhered to each other via the lines of adhesive 18 and 20. This also serves to encase the insert plies 14 within the envelopes defined by each respective front ply 8 and back ply 12. In addition, the web 16 forming the cover sheet is disposed in overlying relation to the front plies 8. Thereafter, all of the superimposed webs are simultaneously perforated at longitudinally spaced intervals to define a series of interconnected mailer units 4 with an overlying cover sheet 16. A single perforation operation is used to form the lines of perforations 26 and 36 in the webs defining the back plies 12 and cover sheet 16, the perforations 26 in the cover sheet 16 form small hinges interconnecting the sections of the cover sheet 16, and also form hinges in the back ply 12 and the tear strips 38 and 40.

The simultaneous perforation of all of the superimposed webs is carried out at intervals corresponding to the length of the mailer units 4.

The perforating blades (not shown) are of conventional construction and have, for example four or five teeth per inch with a gap between adjacent teeth of from 0.030 inch to 0.050 inch depending on the strength and type of paper being perforated.

The longitudinal lines of perforations 22 and 24 are formed on each side of the webs 6, 10, 16 in known manner before, after or during the transverse perforating of the webs.

After the perforating steps have been carried out, the mailer assembly 2 can then be folded into a stacked array as indicated in FIG. 1.

When ply 8 is die cut, plies 12 and 16 permit folding on the transverse perforations. The die cut piece is removed from ply 8 by a conventional method, allowing for easy folding while wet. When the glue dries in the folded position, the forms will still open flat.

As indicated, because the edges of the front plies 8 at the fold areas are not connected to each other, no restraint occurs against folding. Likewise, upon unfolding of the mailer units 4, there is no stressing which tends to create a "tent".

If ply 12 were die cut and ply 8 were perforated, the same results would occur.

As is known, the cover sheet 16 and front plies 8 can be provided with various preprinted boxes or other designated areas to receive information which is collated to similar boxes or areas on the insert plies 14. For example, billing data or like information can be typed onto the boxes of the cover sheet 16 for transfer onto an insert ply 14 in similarly disposed boxes. This information can be transferred by a suitable image transfer means on the back side of the front ply 8 and insert plies 14.

In use, the mailer assembly 2 can be unfolded from a stack and passed through suitable automatic machinery wherein information can be transferred onto the various plies. To this end, use is made of the pin control holes 34 for feeding the assembly 2 through the machinery. After the information has been affixed on the cover sheet 16, the cover sheet 16 can be removed and retained, for example, in an account file by the user. The remaining series of interconnected mailers 4 can then be broken apart and mailed separately. When received by an addressee a mailer 4 can be opened and the enclosed insert plies 14 removed for reading.

The invention thus provides a continuous mailer assembly which will not "tent" when unfolded from a stacked configuration, for example, for processing in automatic equipment.

The invention further provides a relatively simple method of forming a tentless continuous mailer assembly wherein existing equipment can be readily retrofitted to carry out the perforating and die cutting operations.

Although the mailing units 4 have been described with the front plies 8 between the cover sheet 16 and back plies 12, the units 4 may also be used in reverse, i.e. with the "front" plies 8 serving as the back plies of the units 4.

Although the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A continuous tentless mailer assembly comprising a plurality of interconnected units disposed in layers in an array, each said unit including a front ply, a back ply secured to said front ply to define an enclosed envelope, and at least one insert ply between said front ply and said back ply; each of said front ply being cut to remove a narrow transverse strip between left and right sides and only connected to an adjacent front ply in an interrupted manner along removable strips on said left and right sides, each of said back ply being hingedly connected to an adjacent back ply by a perforated line.

2. An assembly as set forth in claim 1 wherein said units are disposed in co-planar pairs in each layer and are folded in a zig-zag manner to define a stack.

3. An assembly as set forth in claim 1 wherein said perforated line ply is directly in line with said transverse strip of said front ply.

4. A continuous tentless mailer assembly comprising a plurality of interconnected units disposed in layers in an array, each said unit including a front ply, a back ply secured to said front ply to define an enclosed envelope, and at least one insert ply between said front ply and said back ply; each said front ply of one of said layers being cut to remove a transverse narrow strip and being unconnected to an adjacent front ply of an adjacent layer except at side perforated tear strips, each said insert ply being unconnected with an adjacent insert ply; and each said back ply of said one layer being hingedly connected to an adjacent back ply of said adjacent layer with a line of perforations.

5. An assembly as set forth in claim 4 wherein each layer includes a plurality of said units disposed in coplanar relation.

6. A continuous tentless mailer assembly comprising a plurality of interconnected units disposed in layers in an array, each said unit including a back ply, a front ply secured to said back ply to define an enclosed envelope, and at least one insert ply between said back ply and said front ply; each said back ply being cut to remove a narrow transverse strip between left and right edges and only connected to an adjacent back ply in an interrupted manner along removable strips on left and right sides, each said front ply being hingedly connected to an adjacent front ply by a line of perforations.

7. An assembly as set forth in claim 6 wherein said units are disposed in co-planar pairs in each layer and are folded in a zigzag manner to define a stack.

8. An assembly as set forth in claim 6 wherein said line of perforations on said front ply is directly in line with said transverse strip of said back layer.

9. A continuous tentless mailer assembly comprising a plurality of interconnected units disposed in layers in an array, each said unit including a back ply, a front ply secured to said back ply to define an enclosed envelope, and at least one insert ply between said back ply and said front ply; each said back ply being cut to remove a transverse narrow strip and being unconnected to an adjacent back ply of an adjacent layer except at side perforated tear strips, each said insert ply being unconnected with an adjacent insert ply; and each said front ply of said one layer being hingedly connected to an adjacent front ply of said adjacent layer by a line of perforations.

10. An assembly as set forth in claim 9 wherein each layer includes a plurality of said units disposed in coplanar relation.

* * * * *